US011896190B1

(12) United States Patent
Xu et al.

(10) Patent No.: US 11,896,190 B1
(45) Date of Patent: Feb. 13, 2024

(54) VACUUM CLEANER AND DOCKING STATION CONFIGURED TO COOPERATE WITH THE SAME

(71) Applicant: SHARKNINJA OPERATING LLC, Needham, MA (US)

(72) Inventors: Kai Xu, Suzhou (CN); Baodong Lu, Suzhou (CN); Yuang Xie, Suzhou (CN); Jingjiang Wu, Suzhou (CN); Queena Li Tan, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/085,009

(22) Filed: Dec. 20, 2022

Related U.S. Application Data

(63) Continuation of application No. PCT/CN2022/118922, filed on Sep. 15, 2022.

(51) Int. Cl.
*A47L 9/14* (2006.01)
*A47L 5/12* (2006.01)
(Continued)

(52) U.S. Cl.
CPC ..... *A47L 9/149* (2013.01); *A47L 5/12* (2013.01); *A47L 9/0063* (2013.01); *A47L 9/106* (2013.01); *A47L 9/2873* (2013.01)

(58) Field of Classification Search
CPC ..... A47L 9/0063; A47L 9/149; A47L 5/12; A47L 9/2873; A47L 9/106; A47L 9/1683; A47L 9/22; A47L 9/2842; A47L 9/2884
See application file for complete search history.

(56) References Cited

U.S. PATENT DOCUMENTS 3,954,426 A 5/1976 Brange
5,198,111 A 3/1993 Davis
(Continued)

FOREIGN PATENT DOCUMENTS

CN 105708389 6/2016
CN 105708389 A * 6/2016 ..... A47L 5/38
(Continued)

OTHER PUBLICATIONS

KR-20070094288-A—English Machine Translation (Year: 2007).*
(Continued)

*Primary Examiner* — Marc Carlson
(74) *Attorney, Agent, or Firm* — Grossman Tucker Perreault Pfleger, PLLC

(57) ABSTRACT

A cleaning system may include a vacuum cleaner and a docking station. The vacuum cleaner may include an air inlet, a suction motor having a suction motor inlet and a suction motor outlet, and a cleaner dust cup configured to transition between a collection position and an emptying position, the cleaner dust cup being upstream of the suction motor inlet when in the collection position and downstream of the suction motor outlet when in the emptying position. The docking station may include a base, a support extending from the base, a station dust cup removably coupled to the support, and a receptacle coupled to the support and configured to receive at least a portion of the vacuum cleaner, the cleaner dust cup being fluidly coupled to and upstream of the station dust cup when the vacuum cleaner is inserted in the receptacle.

30 Claims, 15 Drawing Sheets

(51) Int. Cl.

| | |
|---|---|
| ***A47L 9/00*** | (2006.01) |
| ***A47L 9/10*** | (2006.01) |
| ***A47L 9/28*** | (2006.01) |

(56) References Cited

U.S. PATENT DOCUMENTS

| | | | | |
|---|---|---|---|---|
| 6,122,796 | A | 9/2000 | Downham et al. | |
| 6,991,666 | B2 | 1/2006 | Organ | |
| 7,059,012 | B2 | 6/2006 | Song et al. | |
| 7,288,129 | B2 | 10/2007 | Oh et al. | |
| 7,412,748 | B2 | 8/2008 | Lee et al. | |
| 7,785,381 | B2 | 8/2010 | Oh et al. | |
| 7,849,555 | B2 | 12/2010 | Hahm et al. | |
| 7,951,214 | B2 | 5/2011 | Menrik et al. | |
| 8,069,529 | B2 | 12/2011 | Groff et al. | |
| 8,156,609 | B2 | 4/2012 | Milne et al. | |
| 8,163,051 | B2 | 4/2012 | Yun et al. | |
| 8,635,739 | B2 | 1/2014 | Lee et al. | |
| 8,640,304 | B2 | 2/2014 | Conrad | |
| 8,695,157 | B2 | 4/2014 | Beskow et al. | |
| 8,955,193 | B2 | 2/2015 | Ha et al. | |
| 9,271,618 | B2 | 3/2016 | Mantyla et al. | |
| 9,462,920 | B1 | 10/2016 | Morin et al. | |
| 9,526,391 | B2 | 12/2016 | Lee et al. | |
| 9,788,698 | B2 | 10/2017 | Morin et al. | |
| 9,808,135 | B2 | 11/2017 | Mantyla et al. | |
| 10,136,778 | B2 | 11/2018 | Conrad | |
| 10,244,910 | B2 | 4/2019 | Conrad | |
| 10,512,381 | B2 | 12/2019 | Meggle et al. | |
| 10,791,891 | B2 | 10/2020 | Kuhe et al. | |
| 10,952,578 | B2 | 3/2021 | Gill et al. | |
| 11,213,177 | B2 | 1/2022 | Tonderys et al. | |
| 2008/0201895 | A1 | 8/2008 | Kim et al. | |
| 2013/0305481 | A1 | 11/2013 | Jung et al. | |
| 2014/0137364 | A1* | 5/2014 | Stickney | A47L 5/24 15/347 |
| 2015/0135470 | A1 | 5/2015 | Mantyla et al. | |
| 2015/0196859 | A1 | 7/2015 | Levitt | |
| 2015/0230677 | A1 | 8/2015 | Andrikanish | |
| 2016/0374528 | A1 | 12/2016 | Morin et al. | |
| 2017/0001136 | A1 | 1/2017 | Hensel et al. | |
| 2017/0196420 | A1 | 7/2017 | Brown et al. | |
| 2018/0078107 | A1 | 3/2018 | Gagnon et al. | |
| 2018/0177358 | A1* | 6/2018 | Conrad | A47L 9/1683 |
| 2018/0228335 | A1 | 8/2018 | Miller | |
| 2019/0090701 | A1 | 3/2019 | Tonderys et al. | |
| 2019/0125153 | A1 | 5/2019 | Loveless et al. | |
| 2020/0345196 | A1* | 11/2020 | Innes | A47L 9/1683 |
| 2021/0045600 | A1 | 2/2021 | Schmitz et al. | |
| 2021/0052121 | A1* | 2/2021 | Kim | A47L 9/0009 |
| 2022/0015593 | A1 | 1/2022 | Conrad | |
| 2022/0022712 | A1 | 1/2022 | Gadient et al. | |
| 2022/0031134 | A1 | 2/2022 | Yang et al. | |
| 2022/0047133 | A1 | 2/2022 | Sergyeyenko et al. | |
| 2022/0061614 | A1 | 3/2022 | Yu et al. | |
| 2022/0175206 | A1 | 6/2022 | Li et al. | |
| 2023/0117115 | A1* | 4/2023 | Choi | A47L 5/28 15/319 |
| 2023/0148812 | A1* | 5/2023 | Yang | A47L 9/10 15/347 |

FOREIGN PATENT DOCUMENTS

| | | | | | |
|---|---|---|---|---|---|
| CN | 106963286 | | | 7/2017 | |
| CN | 113317716 | A | * | 8/2021 | |
| CN | 216135772 | | | 3/2022 | |
| CN | 216135772 | U | * | 3/2022 | A47L 9/106 |
| DE | 102012109938 | | | 4/2014 | |
| DE | 102015100057 | | | 7/2016 | |
| DE | 102019004417 | A1 | * | 12/2020 | |
| ES | 2238196 | | | 8/2005 | |
| JP | 2004283327 | | | 10/2004 | |
| JP | 2004283327 | A | * | 10/2004 | |
| KR | 20070094288 | A | * | 9/2007 | |
| KR | 102354485 | B1 | * | 1/2022 | |
| WO | 2016146555 | | | 9/2016 | |
| WO | WO-2020122631 | A1 | * | 6/2020 | |
| WO | WO-2021177699 | A1 | * | 9/2021 | A47L 5/24 |
| WO | WO-2022010198 | A1 | * | 1/2022 | |
| WO | WO-2023018048 | A1 | * | 2/2023 | |

OTHER PUBLICATIONS

PCT Search Report and Written Opinion, dated Jul. 22, 2020, received in PCT Application No. PCT/US2020/030991, 8 pages.

"Ovation HT107 Cordless Folding 2-in-1 Upright and Handheld Stick Vac Vacuum Cleaner with 180 Swivel Steering System", www.amazon.co.uk/Ovation-Cordless-Handheld-Steering-Upholstery, Jan. 14, 2019, 7 pages.

Chinese Office Action with English translation dated Jun. 21, 2022, received in Chinese Patent Application No. 202080047897.7, 25 pages.

US Office Action dated Jul. 1, 2022, received in U.S. Appl. No. 16/864,538, 19 pages.

U.S. Office Action dated Feb. 1, 2023, received in U.S. Appl. No. 16/864,538, 9 pages.

PCT Search Report and Written Opinion dated Jun. 1, 2023, received in PCT Application No. PCT/CN2022/118922, 12 pages.

U.S. Office Action dated Sep. 7, 2023, received in U.S. Appl. No. 16/864,538, 14 pages.

* cited by examiner

VACUUM CLEANER AND DOCKING STATION CONFIGURED TO COOPERATE WITH THE SAME

CROSS-REFERENCE TO RELATED APPLICATIONS

The present application is a continuation of PCT application PCT/CN22/118922, filed Sep. 15, 2022, which is fully incorporated herein by reference.

TECHNICAL FIELD

The present disclosure is generally directed to a vacuum cleaner configured to cooperate with a docking station and more specifically to a vacuum cleaner configured to transfer debris to the docking station.

BACKGROUND INFORMATION

Surface treatment apparatuses are configured to be moved across a surface to be cleaned (e.g., a floor). While being moved across the surface to be cleaned, the surface treatment apparatus is configured to collect at least a portion of debris present on the surface to be cleaned. One example of a surface treatment apparatus is a vacuum cleaner. The vacuum cleaner includes an air inlet, a cleaner dust cup, and a cleaner suction motor configured to cause air to flow into the air inlet and through the cleaner dust cup. The air flow may have debris entrained therein and at least a portion of the entrained debris may be deposited in the cleaner dust cup for later disposal. Debris collected in the cleaner dust cup may be emptied manually (e.g., by a user) or automatically in response to the vacuum cleaner be coupled to a docking station.

The docking station may include a station suction motor and a station dust cup. The station suction motor is configured to fluidly couple to the cleaner dust cup in response to the vacuum cleaner being coupled to the docking station. The station suction motor is configured to suction debris from the cleaner dust cup and into the station dust cup. The station dust cup is configured to retain a larger quantity of debris than the cleaner dust cup.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a cleaning system having a vacuum cleaner configured to removably couple (e.g., dock) with a docking station having a station dust cup. The vacuum cleaner includes a suction motor and a cleaner dust cup, the suction motor being configured to draw air into the cleaner dust cup such at least a portion of debris entrained within the air is deposited within the cleaner dust cup. When the vacuum cleaner is coupled with the docking station, the cleaner dust cup is fluidly coupled to the station dust cup such that the suction motor of the vacuum cleaner can urge the debris deposited in the cleaner dust cup into the station dust cup.

In one example, the cleaner dust cup may be configured to transition from a collection position to an emptying position in response to the vacuum cleaner being coupled to the docking station. When in the collection position, the cleaner dust cup may be fluidly coupled to a suction inlet of the suction motor. When in the emptying position, the cleaner dust cup may be fluidly coupled to a suction outlet of the suction motor. As such, exhaust air from the suction motor may be used to empty the cleaner dust cup into the station dust cup. Such a configuration may reduce the complexity, power consumption, cost, and/or weight of the docking station (e.g., by allowing the docking station to omit a suction motor).

Figure 1:
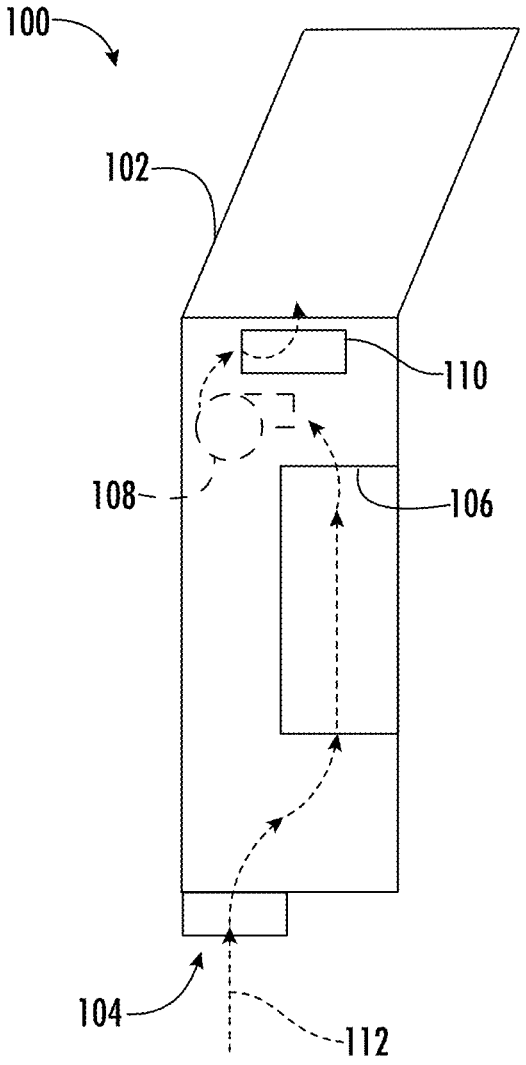
FIG. 1 is a schematic example of vacuum cleaner, consistent with embodiments of the present disclosure.
Figure 2:
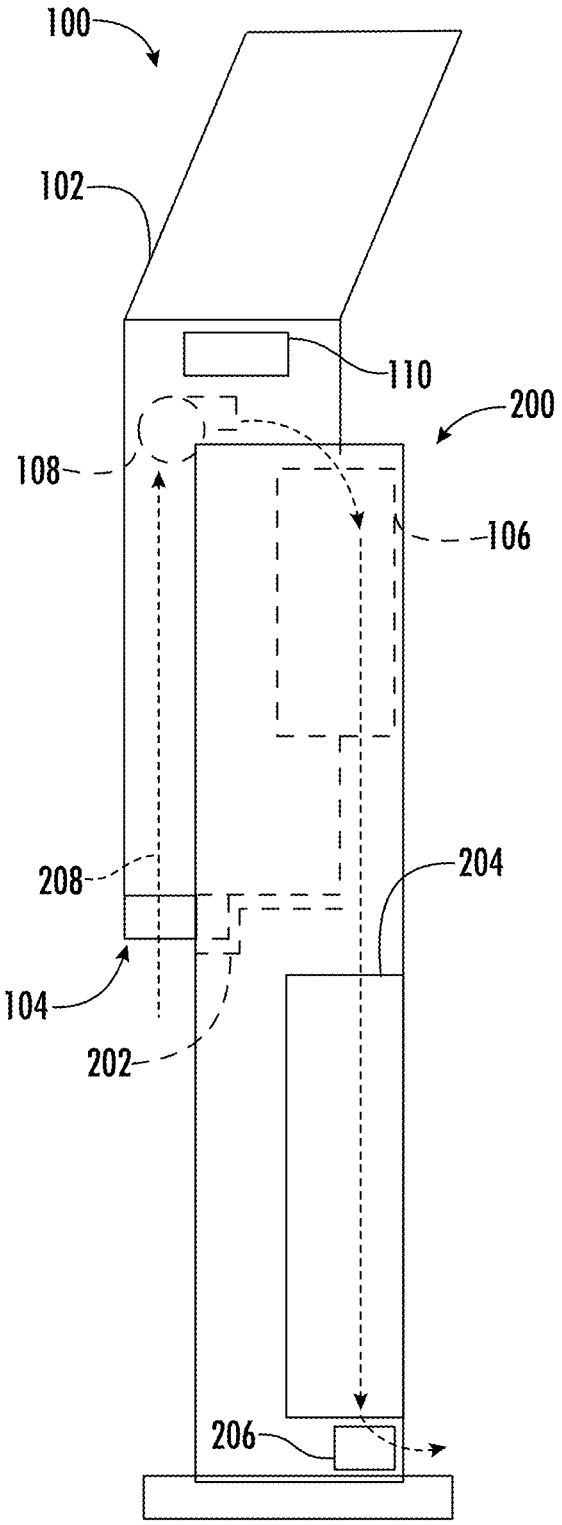
FIG. 2 is a schematic example of the vacuum cleaner of FIG. 1 coupled to a docking station, consistent with embodiments of the present disclosure.

FIG. 1 shows a schematic example of a vacuum cleaner 100 and FIG. 2 shows a schematic example of a cleaning system that includes the vacuum cleaner 100 and a docking station 200, the vacuum cleaner 100 being removably coupled to the docking station 200. The vacuum cleaner 100 includes a handle 102, an air inlet 104, a cleaner dust cup 106, a suction motor 108, and a cleaner air exhaust 110. The cleaner dust cup 106 is configured to transition between a collection position (FIG. 1) and an emptying position (FIG. 2). The docking station 200 includes a receptacle 202 for removably coupling to the vacuum cleaner 100, a station dust cup 204 configured to fluidly couple to the cleaner dust cup 106, and a station air exhaust 206. In some instances, the docking station 200 may be configured to recharge a power supply (e.g., one or more batteries) of the vacuum cleaner 100.

As shown in FIG. 1, when the cleaner dust cup 106 is in the collection position, an inlet side of the suction motor 108 is fluidly coupled to the cleaner dust cup 106 and an outlet side of the suction motor 108 is fluidly coupled to the cleaner air exhaust 110. As such, when in the collection position, the suction motor 108 is configured to cause air to flow along a collection air path 112 that extends from the air inlet 104 through both the cleaner dust cup 106 and the suction motor 108 and out of the cleaner air exhaust 110, wherein air flows through the cleaner dust cup 106 before entering the suction motor 108. In other words, the cleaner dust cup 106 is upstream of the suction motor 108.

As shown in FIG. 2, when the vacuum cleaner 100 is coupled to the docking station 200 and the cleaner dust cup 106 is in the emptying position, the cleaner dust cup 106 is fluidly coupled to the outlet side of the suction motor 108 such that air flows along a station emptying path 208. Air flowing along the station emptying path 208 flows into the air inlet 104 through both the suction motor 108 and the cleaner dust cup 106 into the station dust cup 204 of the docking station 200 and out of the station air exhaust 206, wherein air flows through the suction motor 108 before entering the cleaner dust cup 106 and the station dust cup 204. In other words, the cleaner dust cup 106 is downstream of the suction motor 108 and the station dust cup 204 is downstream of the cleaner dust cup 106. As such, when transitioning from the cleaning position to the emptying position, the cleaner dust cup 106 may generally be described as transitioning from being fluidly coupled to an inlet of the suction motor 108 to an outlet of the suction motor 108.

Transitioning the cleaner dust cup 106 from the collection position to the emptying position in response to the vacuum cleaner 100 being coupled to the docking station 200, allows the suction motor 108 of the vacuum cleaner 100 to be used to empty the contents of the cleaner dust cup 106 into the station dust cup 204. As such, the docking station 200 may not include a suction motor for emptying the cleaner dust cup 106. When the docking station 200 does not include a suction motor, the docking station 200 may generally be referred to as a passive docking station. As should be appreciated, a passive docking station may be configured to carry out one or more non-suction related behaviors (e.g., recharging of a power supply of the vacuum cleaner 100).

Figure 3A:
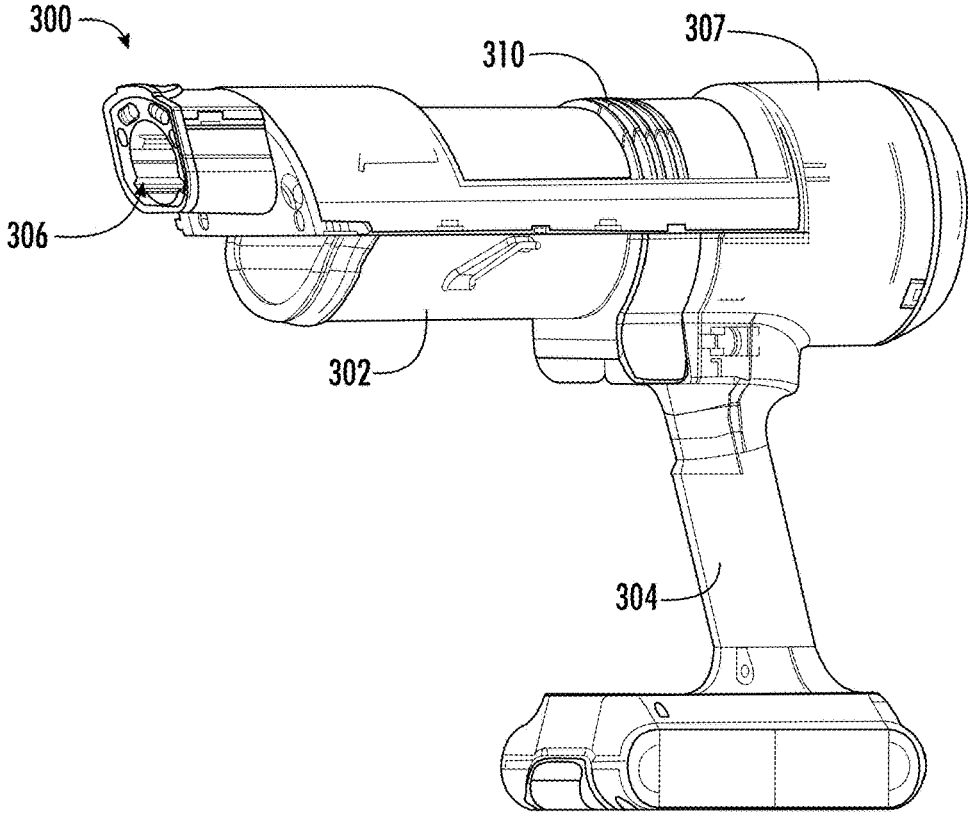
FIG. 3A is a perspective view of an example of a vacuum cleaner having a dust cup in a collection position, consistent with embodiments of the present disclosure.
Figure 3B:
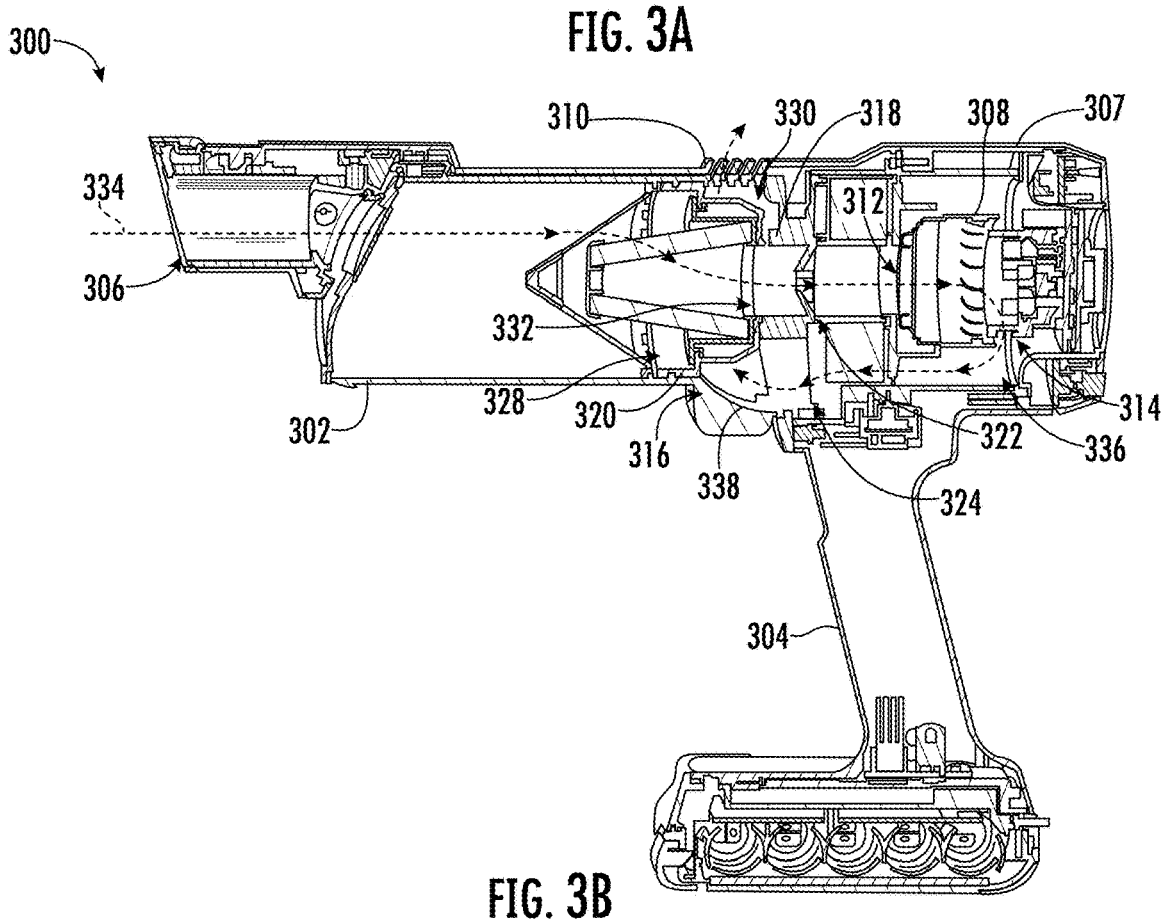
FIG. 3B is a cross-sectional view of the vacuum cleaner of FIG. 3A, consistent with embodiments of the present disclosure.
Figure 4A:
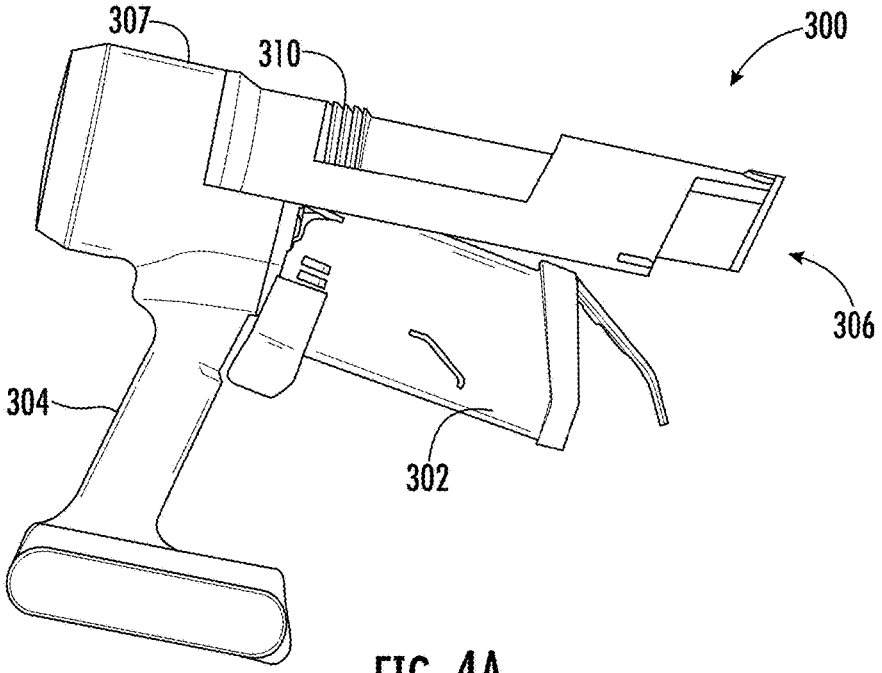
FIG. 4A is a perspective view of the vacuum cleaner of FIG. 3A, wherein the dust cup is in an emptying position, consistent with embodiments of the present disclosure.
Figure 4B:
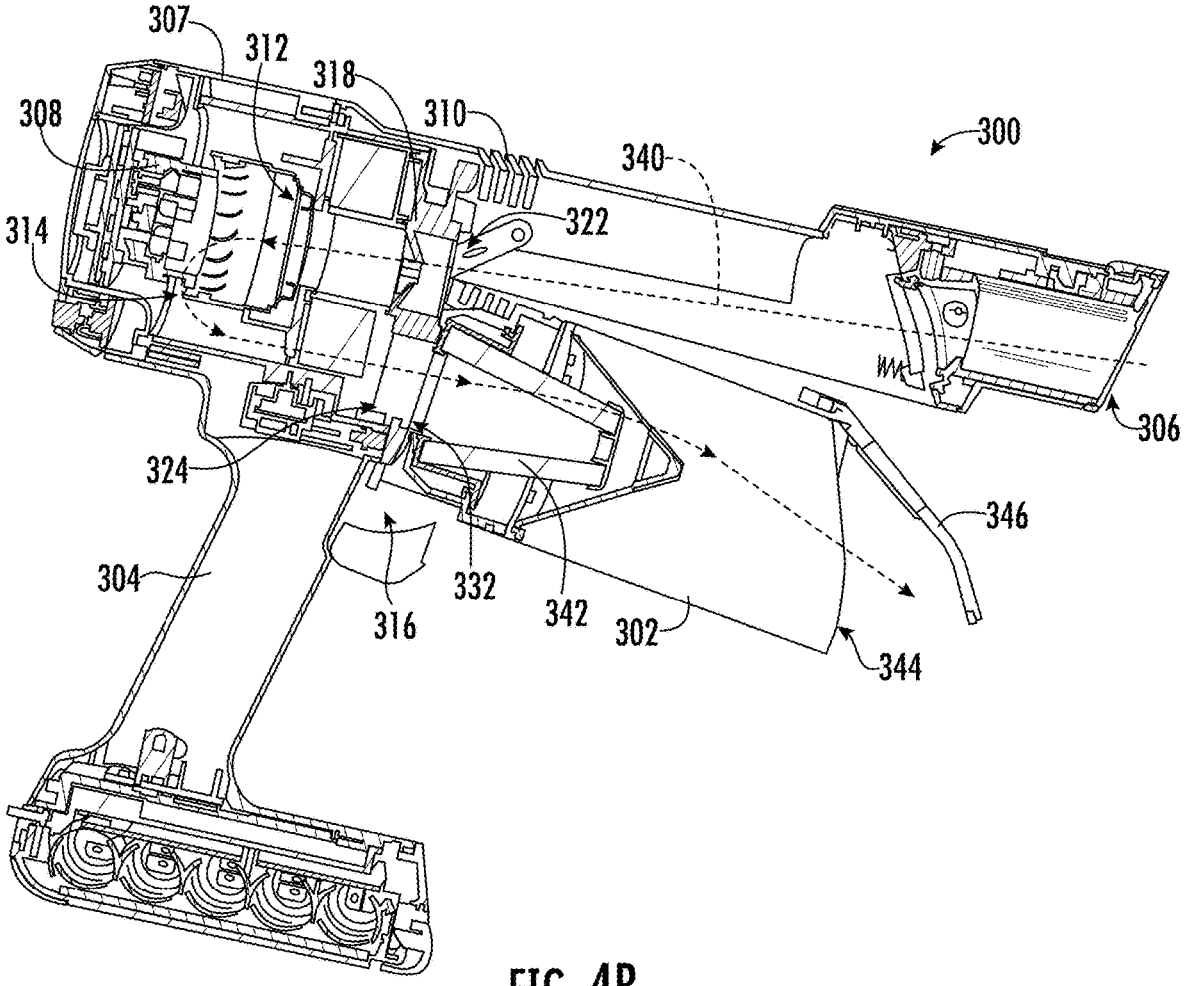
FIG. 4B is a cross-sectional view of the vacuum cleaner of FIG. 4A, consistent with embodiments of the present disclosure.

FIG. 3A shows a perspective view and FIG. 3B shows a cross-sectional view of a vacuum cleaner 300 having a cleaner dust cup 302 in a collection position. FIG. 4A shows a perspective view and FIG. 4B shows a cross-sectional view of the vacuum cleaner 300 having the cleaner dust cup 302 in an emptying position. The vacuum cleaner 300 is an example of the vacuum cleaner 100 of FIG. 1.

As shown, the vacuum cleaner 300 includes a handle 304, an air inlet 306, a main body 307, the cleaner dust cup 302, a suction motor 308, and a cleaner exhaust 310. The suction motor 308 includes a suction motor inlet 312 and a suction motor outlet 314. When the cleaner dust cup 302 is in the collection position, the suction motor inlet 312 is fluidly coupled to the cleaner dust cup 302 such that air is drawn from the air inlet 306 into the cleaner dust cup 302 and through the suction motor 308 to be exhausted from the cleaner exhaust 310. In other words, when in the collection position, the cleaner dust cup 302 is upstream of the suction motor inlet 312. When the cleaner dust cup 302 is in the emptying position, the suction motor outlet 314 is fluidly coupled to the cleaner dust cup 302 such that air exhausted from the suction motor outlet 314 passes through the dust cup 302. In other words, when in the emptying position, the cleaner dust cup 302 is downstream of the suction motor outlet 314.

As shown, in FIGS. 3B and 4B, the vacuum cleaner 300 includes a manifold assembly 316 configured to selectively fluidly couple the cleaner dust cup 302 to one of the suction motor inlet 312 or the suction motor outlet 314. The manifold assembly 316 includes a manifold plate 318 coupled to the main body 307 (e.g., such that the manifold plate 318 is at least partially received within a housing cavity 336 of the main body 307) of the vacuum cleaner 300 and a manifold connector 320 coupled to the cleaner dust cup 302. The manifold plate 318 includes a suction opening 322 and an exhaust outlet 324. The manifold connector 320 includes an inlet side 328 that faces the cleaner dust cup 302, an outlet side 330 opposite the inlet side 328, and an air passthrough 332 extending through the manifold connector 320. The air passthrough 332 is configured to selectively fluidly couple to one of the suction opening 322 (e.g., when the cleaner dust cup 302 in the collection position) or the exhaust outlet 324 (e.g., when the cleaner dust cup 302 is in the emptying position).

As shown in FIG. 3B, when the cleaner dust cup 302 is in the collection position, the suction motor 308 is configured to cause air to flow along a collection air path 334. The collection air path 334 extends from the air inlet 306 into the cleaner dust cup 302 through the air passthrough 332 of the manifold connector 320 and the suction opening 322 of the manifold plate 318 and into the suction motor inlet 312. From the suction motor inlet 312, the collection air path 334 extends to the suction motor outlet 314 into the housing cavity 336 of the main body 307 of the vacuum cleaner 300 through the exhaust outlet 324 and into the cleaner exhaust 310. As shown, the cleaner dust cup 302 defines a deflector surface 338 that cooperates with the outlet side 330 of the manifold connector 320 and the manifold plate 318 to direct air flowing along the collection air path 334 towards the cleaner exhaust 310. The deflector surface 338 may be an arcuate surface extending from the cleaner dust cup 302 towards the main body 307 of the vacuum cleaner 300. The deflector surface 338 may engage (e.g., sealingly engage) the manifold plate 318 of the vacuum cleaner 300 when the cleaner dust cup 302 is in the collection position.

As shown in FIG. 4B, when the cleaner dust cup 302 is in the emptying position, the suction motor 308 is configured to cause air to flow along an emptying air path 340. As shown, the emptying air path 340 enters through the suction opening 322 of the manifold plate 318 without passing through the cleaner dust cup 302. From the suction opening 322, the emptying air path 340 enters the suction motor inlet 312, passes through the suction motor 308, and exits the suction motor 308 through the suction motor outlet 314. From the suction motor outlet 314, the emptying air path 340 extends through the exhaust outlet 324 of the manifold plate 318 and through the air passthrough 332 of the manifold connector 320 to enter the cleaner dust cup 302. As shown, when entering the cleaner dust cup 302, the emptying air path 340 may extend through one or more dust cup filters 342. Such a configuration may dislodge at least a portion of any debris adhered to the one or more dust cup filters 342. The emptying air path 340 exits the cleaner dust cup 302 from a selectively enclosable open end 344 of the cleaner dust cup 302. The selectively enclosable open end 344 may be opposite the manifold assembly 316. As shown, the cleaner dust cup 302 may include an openable door 346 configured selectively open and close the selectively enclosable open end 344. The openable door 346 may be pivotally coupled to the cleaner dust cup 302 such that the openable door 346 pivots between an open and closed position (e.g., in response to the cleaner dust cup 302 transitioning between the collection and emptying positions). In some instances, the openable door 346 may be biased towards the closed position.

Figure 5:
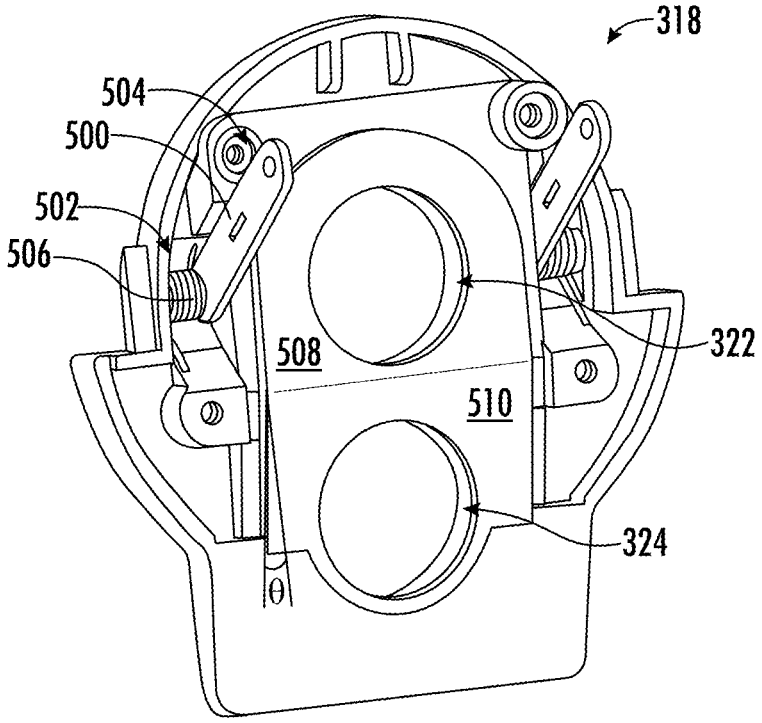
FIG. 5 is a perspective view of a manifold plate of the vacuum cleaner of FIG. 3A, consistent with embodiments of the present disclosure.
Figure 6:
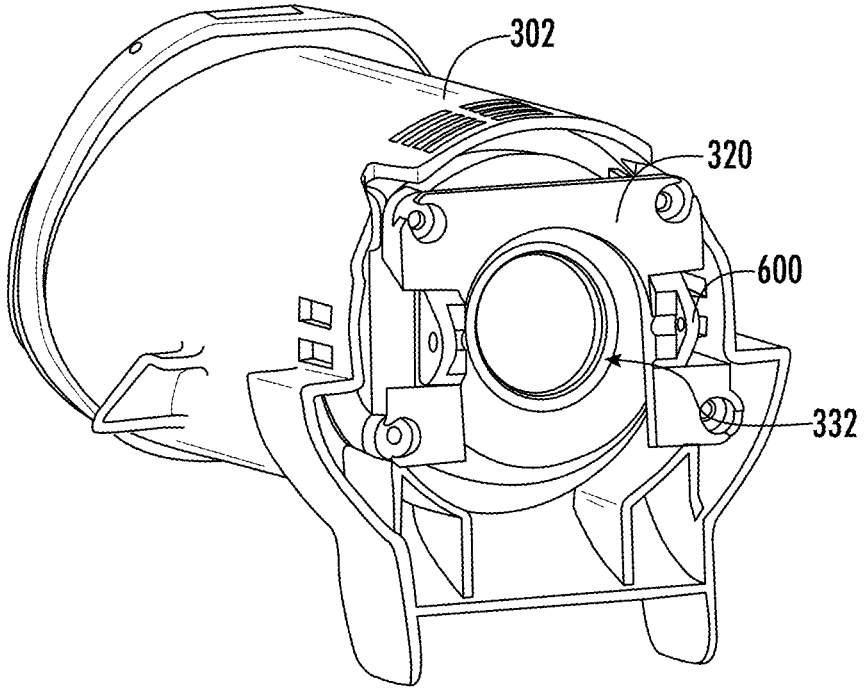
FIG. 6 is a perspective view of the dust cup of the vacuum cleaner of FIG. 3A, consistent with embodiments of the present disclosure.

FIG. 5 shows a perspective view of the manifold plate 318 and FIG. 6 shows a perspective view of the manifold connector 320 coupled to the cleaner dust cup 302.

As shown, the manifold assembly 316 includes a plurality of pivot arms 500 configured to pivotally couple the manifold plate 318 to the manifold connector 320. The plurality of pivot arms 500 are configured to pivot such that the manifold connector 320 moves relative to the manifold plate 318 in response to the cleaner dust cup 302 transitioning between the collection position and the emptying position. The plurality of pivot arms 500 each have a first pivot end 502 and a second pivot end 504 that is opposite the first pivot end 502. The first pivot end 502 of each pivot arm 500 is pivotally coupled to the manifold plate 318. The second pivot end 504 of each pivot arm 500 is pivotally coupled to the manifold connector 320. As shown, the manifold connector 320 includes a plurality of pivot connectors 600 configured to pivotally couple to a respective second pivot end 504. When the cleaner dust cup 302 is transitioned between the collection and emptying positions, the pivot arms 500 are configured to pivot. As shown, the pivot arms 500 may be biased to urge the cleaner dust cup 302 towards the collection position. For example, the manifold plate 318 may include a biasing mechanism 506 (e.g., a torsion spring) configured to bias the pivot arms 500 such that the cleaner dust cup 302 is urged towards the collection position.

As shown in FIG. 5, the suction opening 322 of the manifold plate 318 is formed in a first surface 508 of the manifold plate 318 and the exhaust outlet 324 of the manifold plate 318 is formed in a second surface 510 of the manifold plate 318. The first surface 508 and the second surface 510 are angled relative to each other to form a manifold plate angle θ. The manifold plate angle θ may be configured such that pivotal movement of the cleaner dust cup 302 and the manifold connector 320 relative to the manifold plate 318 results in the air passthrough 332 of the manifold connector 320 selectively fluidly coupling to one of the exhaust outlet 324 (e.g., by sealingly engaging with the manifold plate 318 at the exhaust outlet 324) or the suction opening 322 (e.g., by sealingly engaging with the manifold plate 318 at the suction opening 322).

Figure 7:
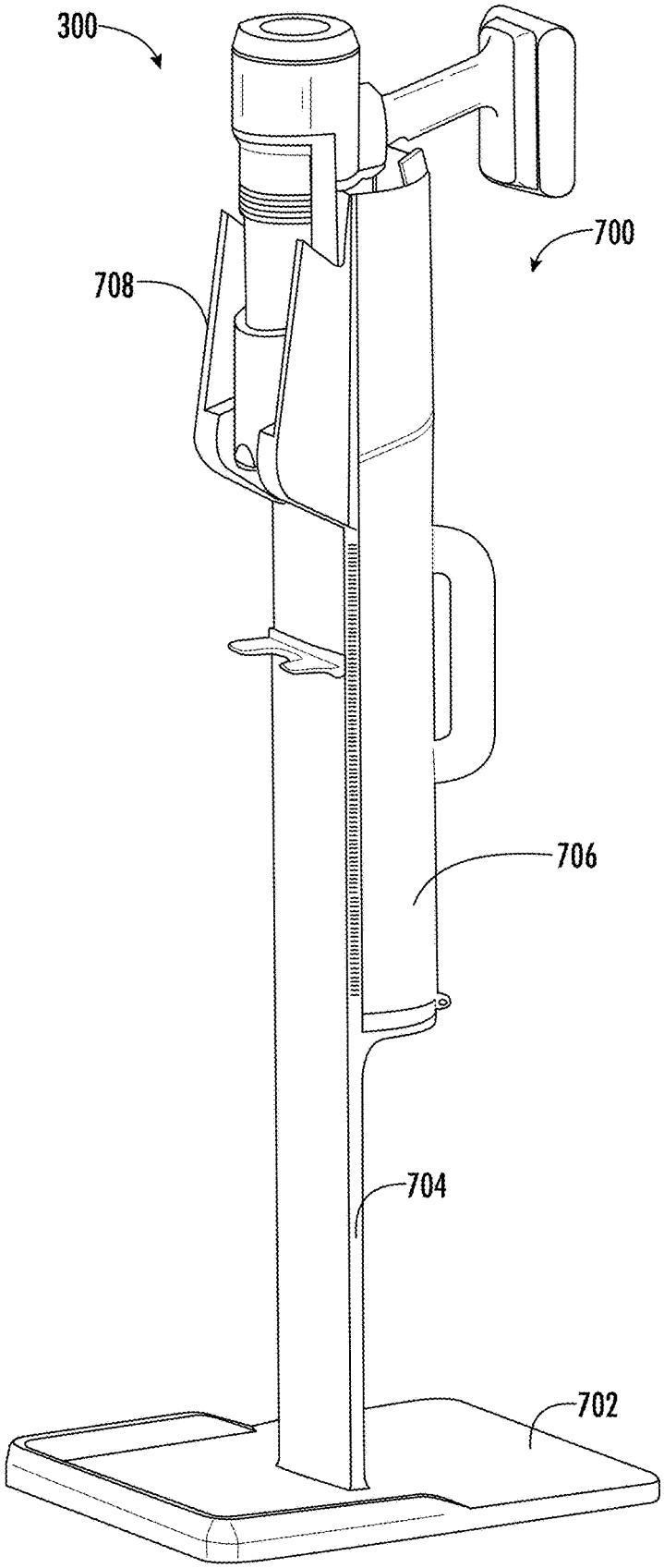
FIG. 7 is a perspective view of the vacuum cleaner of FIG. 3A coupled to a docking station, consistent with embodiments of the present disclosure.

FIG. 7 shows a perspective view of the vacuum cleaner 300 removably coupled to (docked with) a passive docking station 700, the passive docking station 700 is an example of the docking station 200 of FIG. 2. As shown, the passive docking station 700 includes a base 702, a support 704 extending from the base 702, a station dust cup 706 removably coupled to the support 704, and a receptacle 708 coupled to the support 704 and configured to receive at least a portion of the vacuum cleaner 300. The receptacle 708 may include one or more charging contacts configured to recharge a power source (e.g., one or more batteries) of the vacuum cleaner 300. The passive docking station 700 does not include a suction motor.

Figure 8:
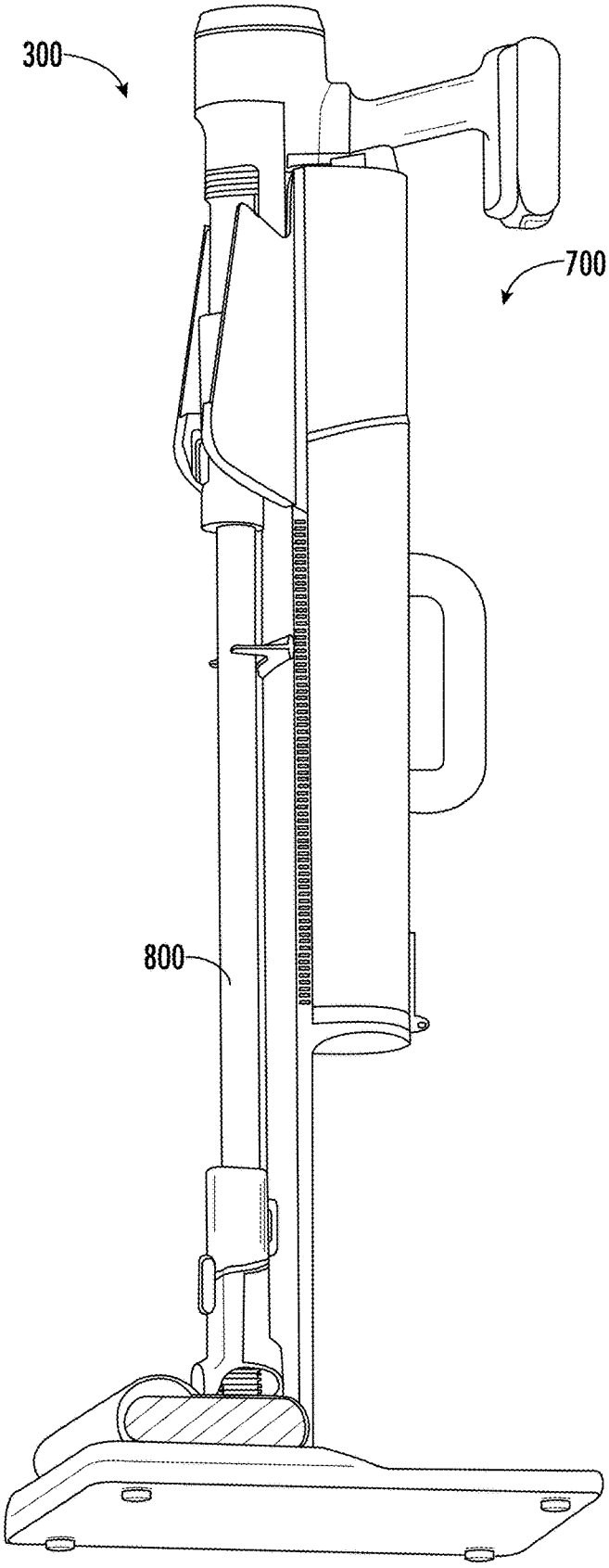
FIG. 8 is a perspective view of the vacuum cleaner coupled to the docking station of FIG. 7, wherein the vacuum cleaner includes one or more accessories removably coupled thereto, consistent with embodiments of the present disclosure.

As shown in FIG. 8, the passive docking station 700 may be further configured to support and/or removably couple to one or more cleaning accessories 800 (e.g., a cleaning wand, a surface cleaning head, and/or any other cleaning accessory). The one or more cleaning accessories 800 are configured to removably couple to the vacuum cleaner 300. The vacuum cleaner 300 may be removed from the passive docking station 700 while coupled to the one or more cleaning accessories 800 or separately from the one or more cleaning accessories 800.

Figure 9:
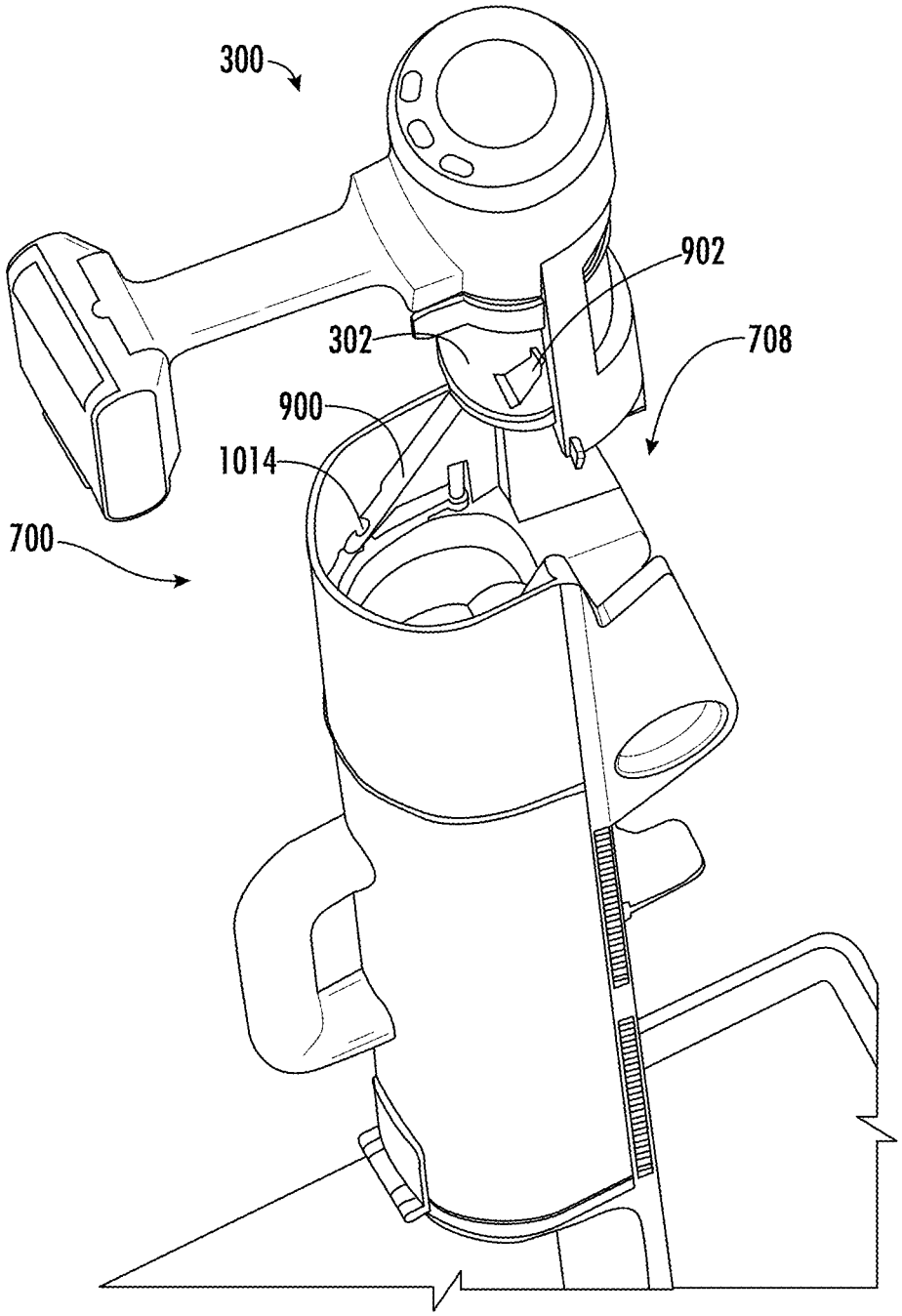
FIG. 9 is a perspective view of the vacuum cleaner of FIG. 3 being docked with the docking station of FIG. 7, consistent with embodiments of the present disclosure.

FIG. 9 shows a perspective view of the vacuum cleaner 300 being inserted into the receptacle 708 of the passive docking station 700. As shown, the receptacle 708 includes ramps 900 configured to engage corresponding protrusions 902 of the cleaner dust cup 302. Engagement between the ramps 900 and the protrusions 902 urges the cleaner dust cup 302 to transition from the collection position to the emptying position in response to the vacuum cleaner 300 being inserted into the receptacle 708. In some instances, a latch retaining the cleaner dust cup 302 in the collection position may be actuated in response to the vacuum cleaner being inserted into the receptacle 708, allowing the ramps 900 to move the cleaner dust cup 302 to the emptying position.

Figure 10:
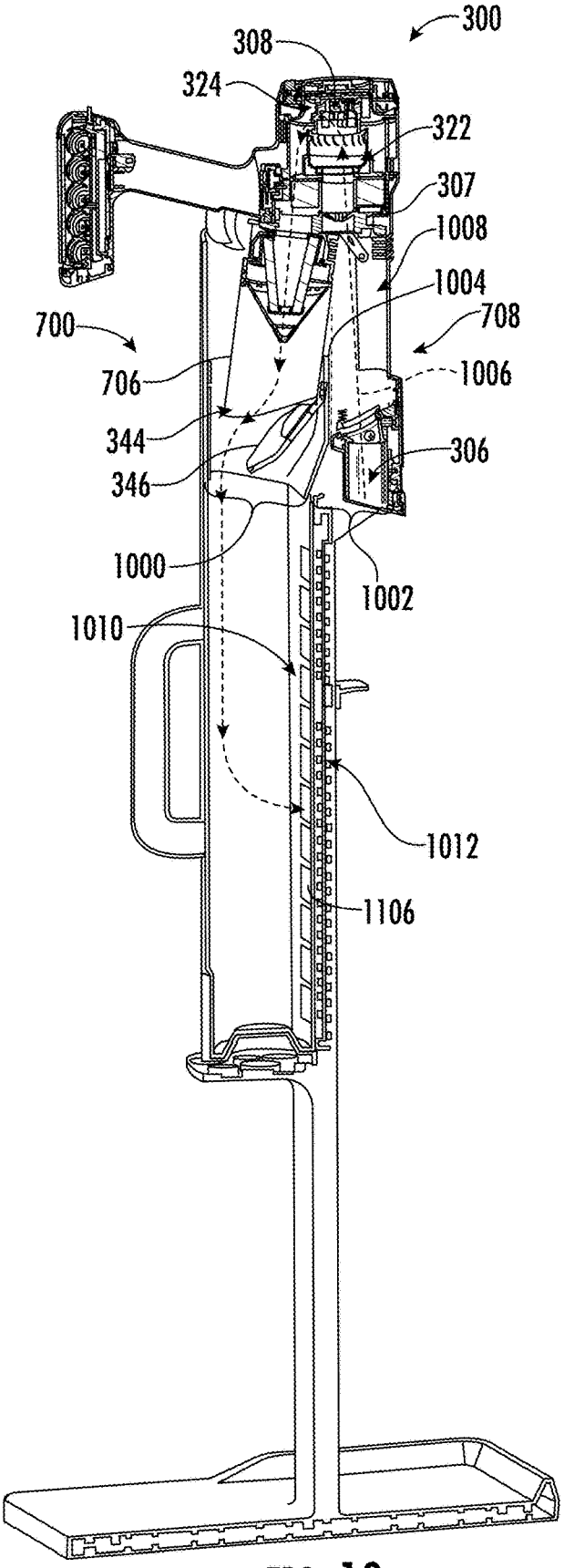
FIG. 10 is a cross-sectional view of the vacuum cleaner and docking station of FIG. 7, consistent with embodiments of the present disclosure.

FIG. 10 shows a cross-sectional view of the vacuum cleaner 300 coupled to the passive docking station 700. As shown, the receptacle 708 includes a dust cup region 1000 and an inlet region 1002. A divider 1004 extends between the dust cup region 1000 and the inlet region 1002, separating the dust cup region 1000 from the inlet region 1002. The dust cup region 1000 is configured to receive at least a portion of the cleaner dust cup 302 and the inlet region 1002 is configured to receive at least a portion of the air inlet 306 of the vacuum cleaner 300.

The dust cup region 1000 is configured to fluidly couple the cleaner dust cup 302 to the station dust cup 706 such that debris within the cleaner dust cup 302 can be transferred into the station dust cup 706. In other words, the dust cup region 1000 is configured to fluidly couple the cleaner dust cup 302 to the station dust cup 706 such that the cleaner dust cup 302 is upstream of the station dust cup 706. As shown, the dust cup region 1000 is configured such that the openable door 346 can transition to the open position when the cleaner dust cup 302 is received within the dust cup region 1000. In some instances, the dust cup region 1000 may be configured to cause the openable door 346 to transition to the open position in response to the cleaner dust cup 302 being inserted into the dust cup region 1000. As such, the receptacle 708 may generally be described as being configured to transition the openable door 346 to the open position in response to the vacuum cleaner 300 being inserted into the receptacle. In some instances, the openable door 346 may be caused to transition to the open position in response to air being exhausted through the cleaner dust cup 302 (e.g., when the cleaner dust cup 302 is in the emptying position).

The inlet region 1002 is configured such that the air inlet 306 is fluidly coupled to a surrounding environment such that the suction motor 308 of the vacuum cleaner 300 can cause air from the surrounding environment to be drawn into the air inlet 306. The drawn in air is exhausted from the suction motor 308 and into the cleaner dust cup 302 such that debris within the cleaner dust cup 302 is transferred to the station dust cup 706.

As shown, when the vacuum cleaner 300 is coupled to the passive docking station 700, the suction motor 308 is configured to cause air to flow along a station emptying path 1006. The station emptying path 1006 extends from the air inlet 306 along a channel 1008 defined between the main body 307 of the vacuum cleaner, the cleaner dust cup 302, and the divider 1004. From the channel 1008, the station emptying path 1006 extends through the suction opening 322 of the manifold plate 318 and into the suction motor 308. From the suction motor 308, the station emptying path 1006 extends through the exhaust outlet 324 and into the cleaner dust cup 302. The station emptying path 1006 exits the cleaner dust cup 302 through the selectively enclosable open end 344 and enters the station dust cup 706. The station emptying path 1006 exits the station dust cup 706 through a station air exhaust 1010 of the passive docking station 700. At least a portion of the station air exhaust 1010 may be formed in one or more of the station dust cup 706 and/or the support 704. The station air exhaust 1010 may include one or more station filters 1012. The one or more station filters 1012 may be, for example, a high efficiency particulate air (HEPA) filter.

In some instances, the suction motor 308 may be configured to cause air to flow along the station emptying path 1006 in response to the vacuum cleaner 300 being coupled to the passive docking station 700. For example, the passive docking station 700 may include one or more charging contacts 1014 (FIG. 9) configured to generate a signal that is received by the vacuum cleaner 300 when the vacuum cleaner 300 is coupled to the passive docking station 700. In response to receiving the signal, the suction motor 308 may be caused to activate. The generated signal may be an electrical charging signal that is configured to charge one or more batteries of the vacuum cleaner 300.

Figure 11:
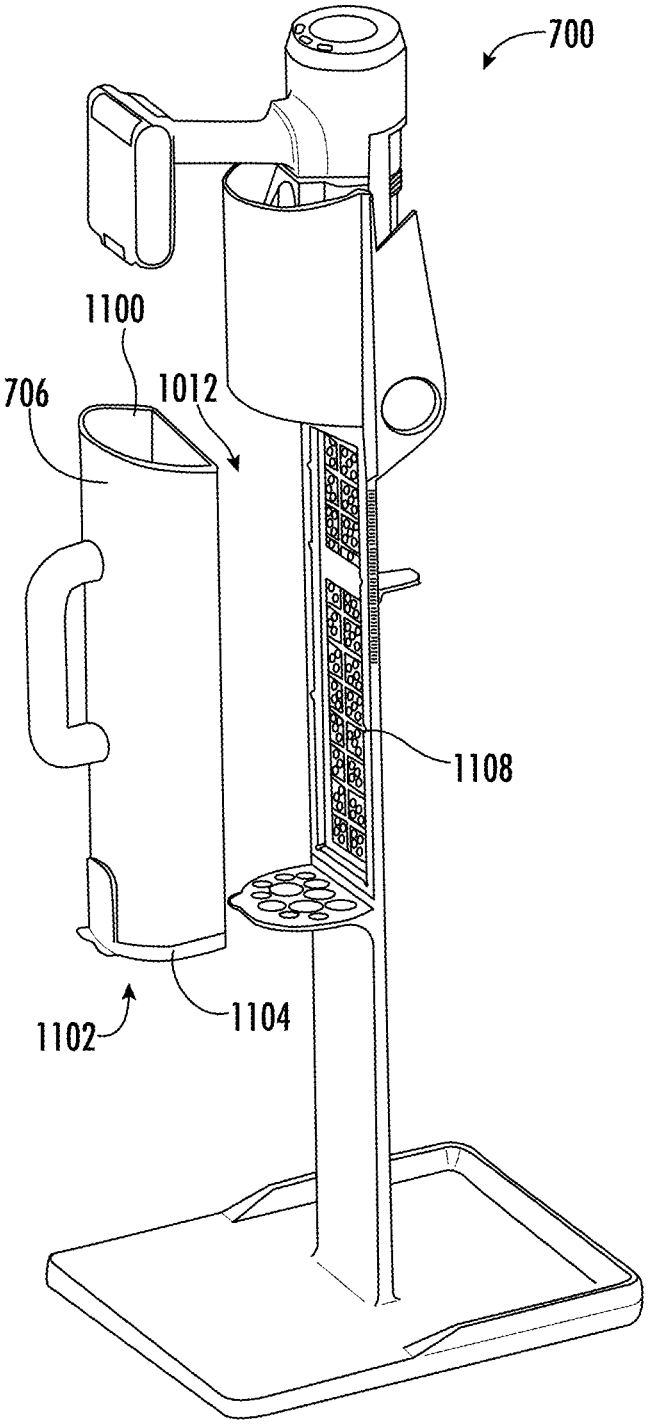
FIG. 11 is a perspective view of the vacuum cleaner and docking station of FIG. 7 having a station dust cup being removed from the docking station, consistent with embodiments of the present disclosure.

FIG. 11 shows an example of the passive docking station 700 having the station dust cup 706 removed therefrom (e.g., for the purposes of emptying the station dust cup 706). As shown, the station dust cup 706 includes a station dust cup open end 1100 and a selectively enclosable emptying end 1102 opposite the station dust cup open end 1100. A station dust cup door 1104 may be pivotally coupled to the station dust cup 706 for selectively enclosing the selectively enclosable emptying end 1102.

As also shown, the station air exhaust 1010 may include a plurality of station filters 1012. For example, a first filter 1106 (FIG. 10) may be coupled to the station dust cup 706 and a second filter 1108 may be coupled to the support 704. The second filter 1108 may be configured to collect smaller debris than the first filter 1106. In this example, the first filter 1106 may generally be described as a coarse filter (e.g., a mesh screen) and the second filter 1108 may generally be described as a fine filter (e.g., a HEPA filter). The first filter 1106 may be configured to retain debris within the station dust cup 706 when the station dust cup 706 is decoupled from the support 704.

Figure 12A:
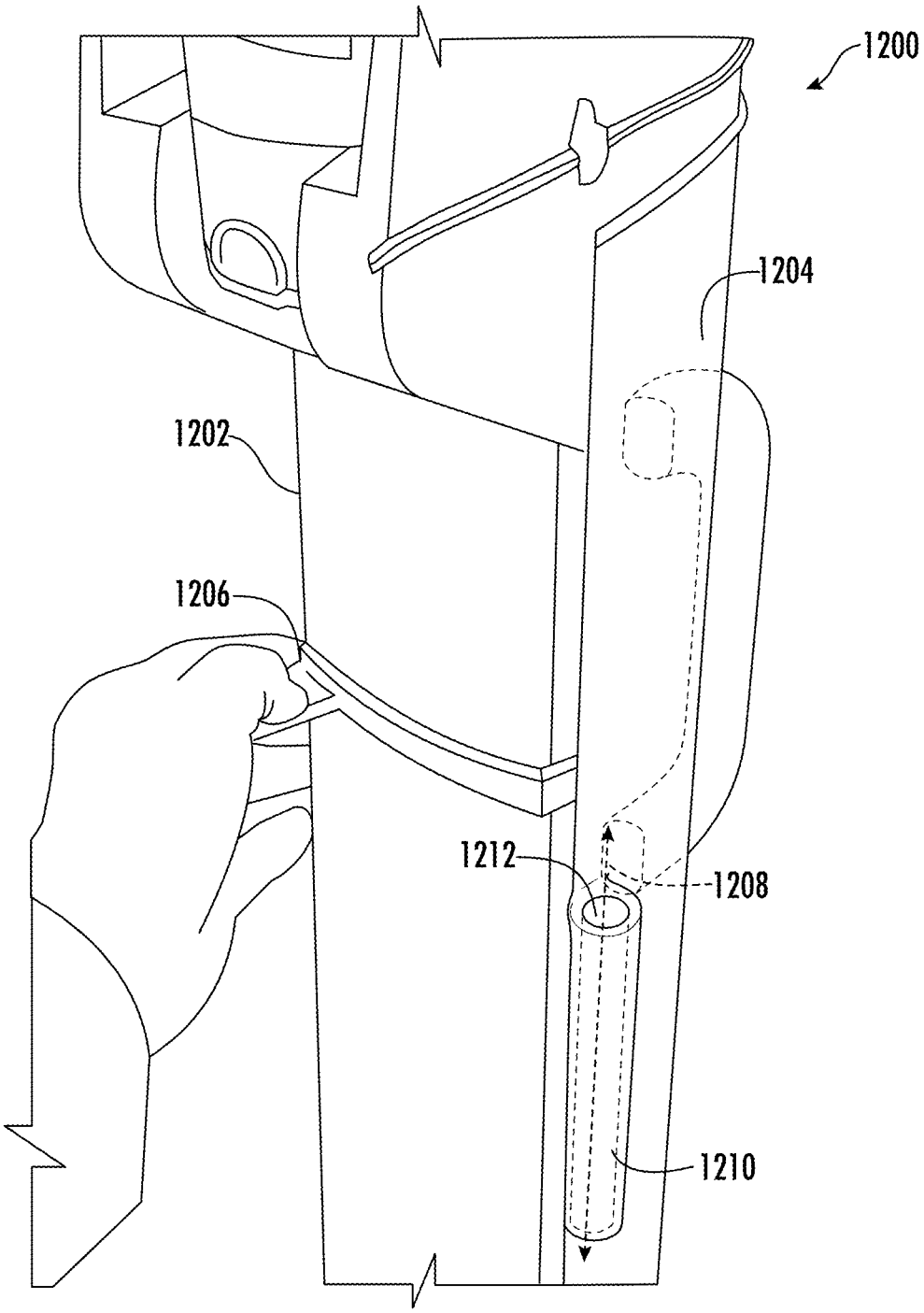
FIG. 12A is a perspective view of a docking station having a station dust cup in a use position, consistent with embodiments of the present disclosure.
Figure 12B:
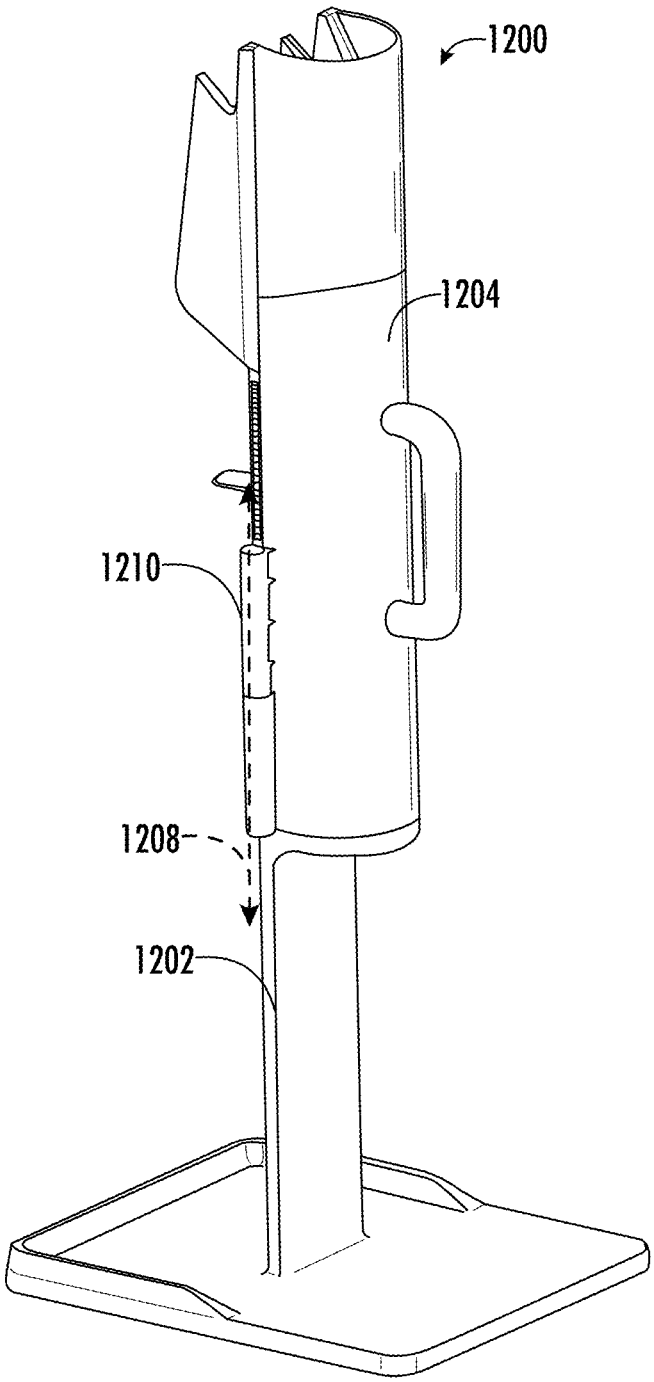
FIG. 12B shows a perspective view of an example of the docking station of FIG. 12A, consistent with embodiments of the present disclosure.
Figure 13A:
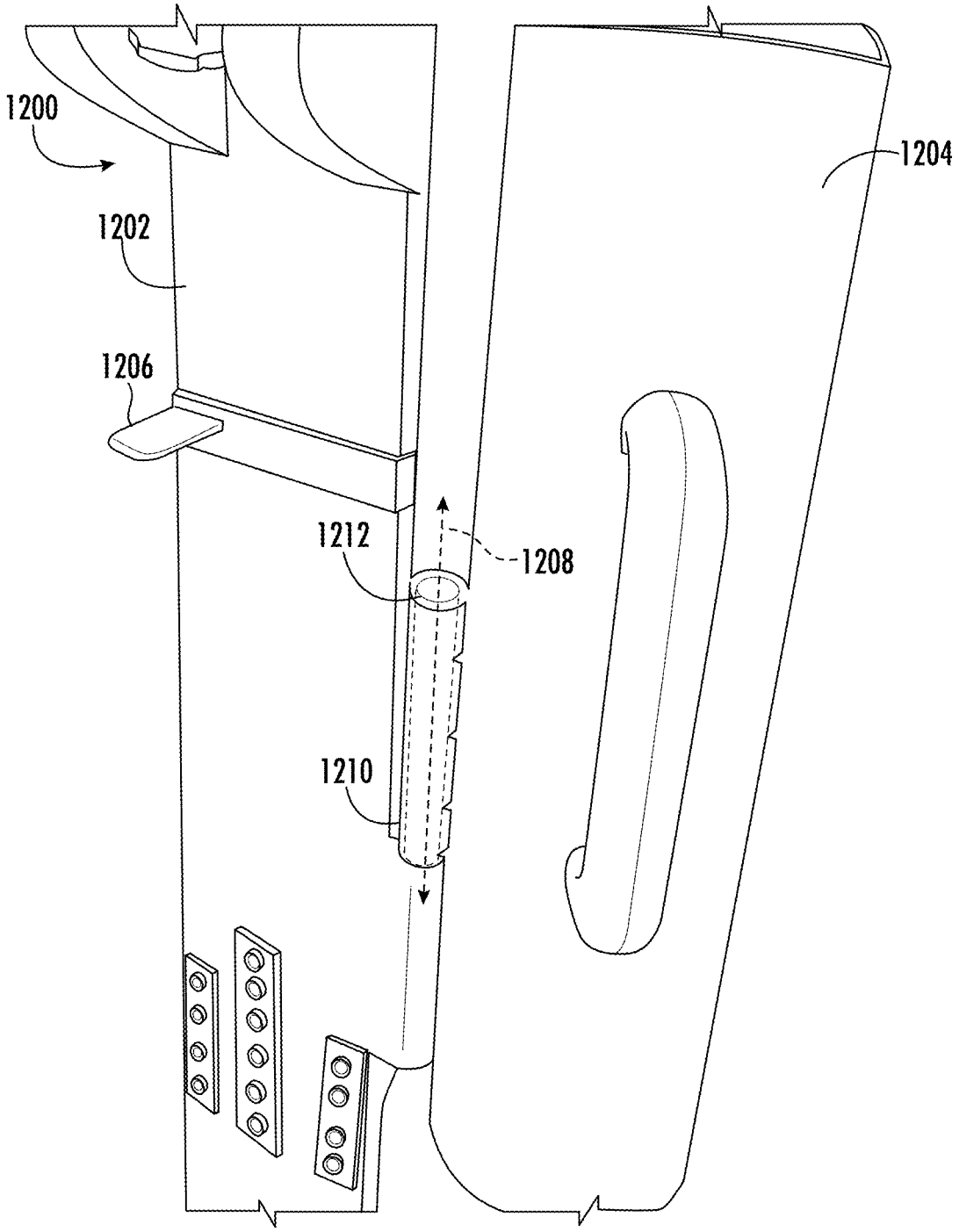
FIG. 13A is a perspective view of the docking station of FIG. 12 having the station dust cup in a removal position, consistent with embodiments of the present disclosure.
Figure 13B:
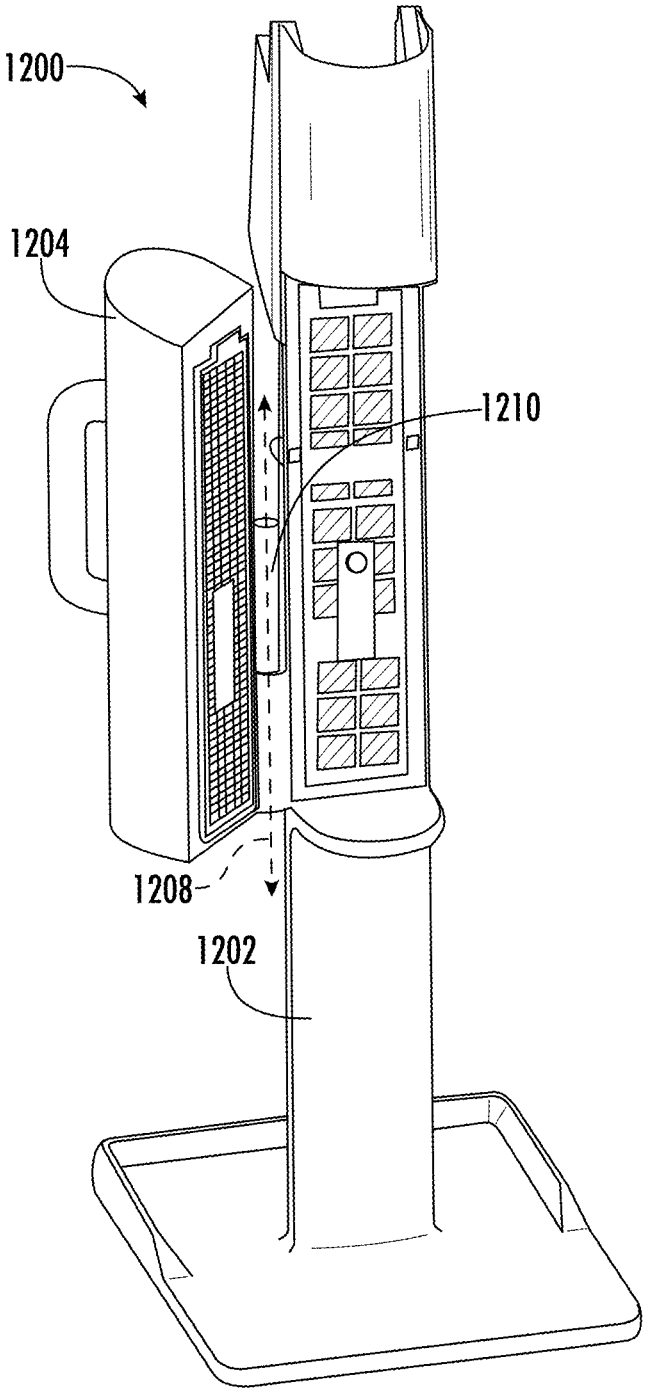
FIG. 13B shows a perspective view of an example of the docking station of FIG. 13A, consistent with embodiments of the present disclosure.
Figure 14A:
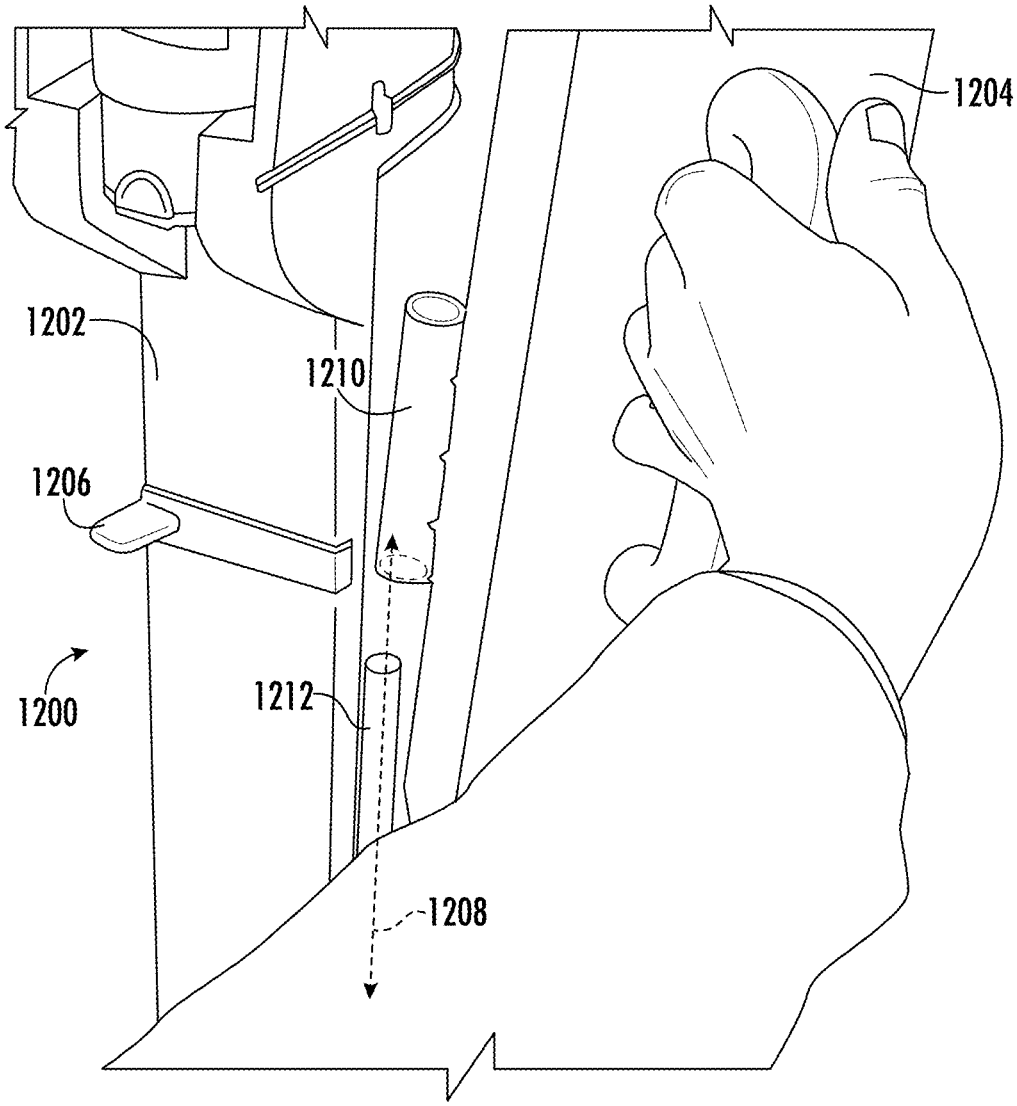
FIG. 14A is a perspective view of the docking station of FIG. 12 having the station dust cup being removed therefrom, consistent with embodiments of the present disclosure.
Figure 14B:
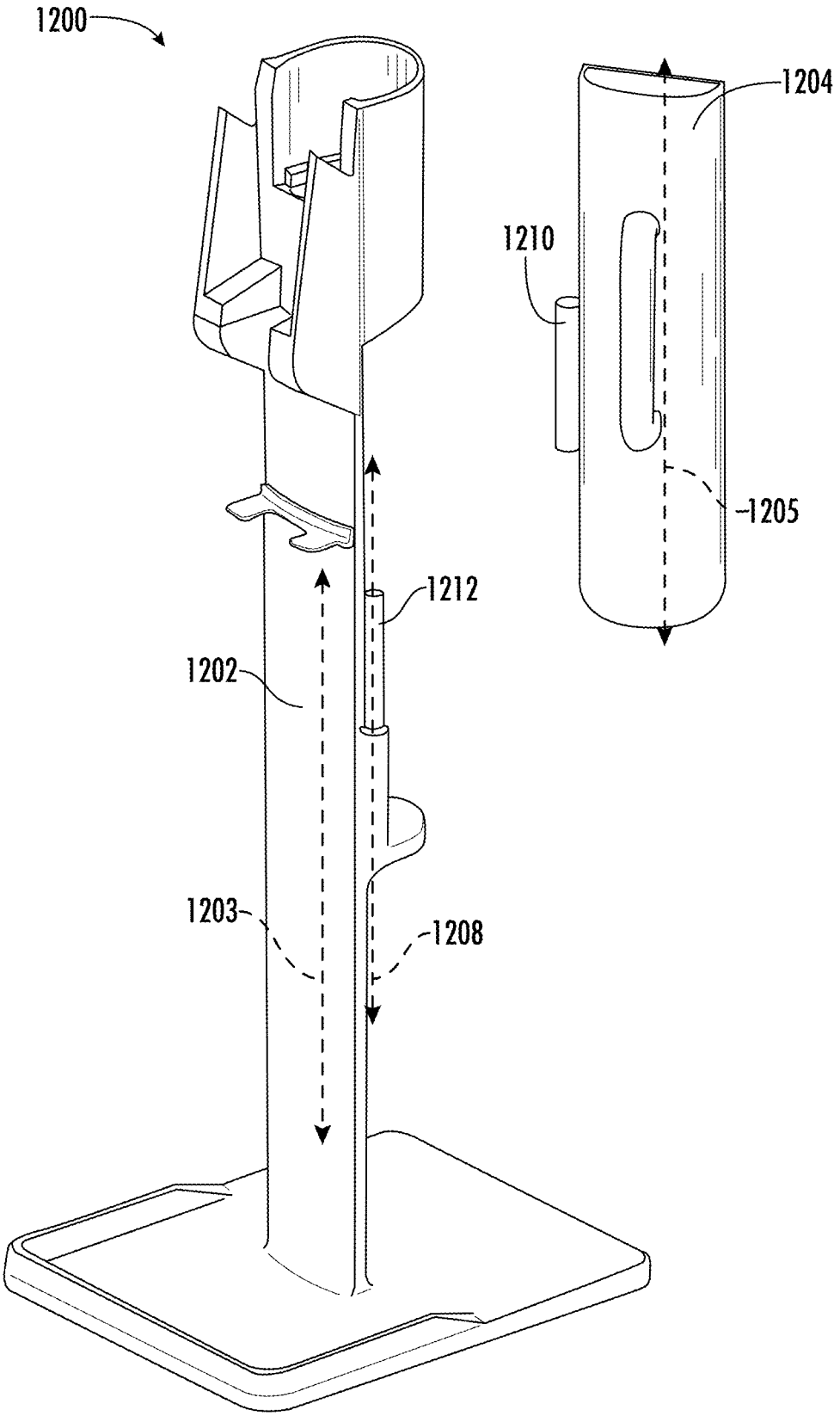
FIG. 14B shows a perspective view of an example of the docking station of FIG. 14A, consistent with embodiments of the present disclosure.

FIGS. 12A-14B show an example of a docking station 1200. The docking station 1200 is an example of the docking station 200 of FIG. 2 and/or the passive docking station 700 of FIG. 7. As shown in FIGS. 12A and 12B, the docking station 1200 includes a support 1202 and a station dust cup 1204 removably coupled to the support 1202, the station dust cup 1204 being in a use position. As shown in FIGS. 13A and 13B, in response to actuation of a dust cup lever 1206, the station dust cup 1204 is caused to pivot towards a removal position. For example, the station dust cup 1204 may be biased (e.g., using a spring) towards the removal position and actuation of the dust cup lever 1206 may release a dust cup latch that retains the station dust cup 1204 in the use position. When pivoting towards the removal position, the station dust cup 1204 pivots about a pivot axis 1208. The pivot axis 1208 may be parallel to a longitudinal axis 1203 of the support 1202 and/or a longitudinal axis 1205 of the station dust cup 1204. FIGS. 14A and 14B show the station dust cup 1204 being removed from the support 1202 (e.g., for emptying). As also shown in FIGS. 14A and 14B, the station dust cup 1204 includes a hinge receptacle 1210 and the support 1202 includes a hinge pin 1212, wherein the hinge receptacle 1210 is configured to receive at least a portion of the hinge pin 1212. The hinge receptacle 1210 and the hinge pin 1212 are configured to collectively form a hinge assembly, wherein the hinge pin 1212 defines the pivot axis 1208. When the station dust cup 1204 is being decoupled from the support 1202, the hinge receptacle 1210 slides relative to the hinge pin 1212 until the hinge pin 1212 is removed from the hinge receptacle 1210. As such, the hinge receptacle 1210 and the hinge pin 1212 may be generally described as collectively forming a hinge assembly that is configured to removably and pivotally couple the station dust cup 1204 to the support 1202.

An example of a cleaning system, consistent with the present disclosure, may include a vacuum cleaner and a docking station. The vacuum cleaner may include an air inlet, a suction motor having a suction motor inlet and a suction motor outlet, and a cleaner dust cup configured to transition between a collection position and an emptying position, the cleaner dust cup being upstream of the suction motor inlet when in the collection position and downstream of the suction motor outlet when in the emptying position. The docking station may include a base, a support extending from the base, a station dust cup removably coupled to the support, and a receptacle coupled to the support and configured to receive at least a portion of the vacuum cleaner, the cleaner dust cup being fluidly coupled to and upstream of the station dust cup when the vacuum cleaner is received in the receptacle.

In some instances, the receptacle may include a dust cup region for receiving at least a portion of the cleaner dust cup, an inlet region for receiving at least a portion of the air inlet of the vacuum cleaner, and a divider that extends between the dust cup region from the inlet region. In some instances, the vacuum cleaner may include a manifold assembly configured to selectively fluidly couple the cleaner dust cup to one of the suction motor inlet or the suction motor outlet. In some instances, the manifold assembly may include a manifold plate coupled to a main body of the vacuum cleaner and a manifold connector coupled to the cleaner dust cup. In some instances, the manifold assembly may include a plurality of pivot arms pivotally coupling the manifold plate to the manifold connector. In some instances, the docking station further may include a station air exhaust, at least a portion of the station air exhaust is formed from the station dust cup. In some instances, at least a portion of the station air exhaust may be formed from the support. In some instances, the station air exhaust may include a plurality of filters, a first filter being coupled to the station dust cup and a second filter being coupled to the support, the second filter being configured to filter smaller debris than the first filter. In some instances, the receptacle may include a plurality of ramps configured to engage corresponding protrusions of the cleaner dust cup to transition the cleaner dust cup from the collection position to the emptying position in response to the vacuum cleaner being inserted into the receptacle. In some instances, the cleaner dust cup may include an open end and an openable door pivotally coupled to the cleaner dust cup to selectively enclose the open end. In some instances, the openable door may be transitioned to an open position in response to the vacuum cleaner being inserted into the receptacle. In some instances, the docking station may further include one or more charging contacts configured to generate a signal, the suction motor being activated in response to receiving the signal.

An example of a vacuum cleaner, consistent with the present disclosure, may include a suction motor having a suction motor inlet and a suction motor outlet and a cleaner dust cup configured to transition between a collection position and an emptying position, the cleaner dust cup being upstream of the suction motor inlet when in the collection position and downstream of the suction motor outlet when in the emptying position.

In some instances, the cleaner dust cup may include an open end and an openable door pivotally coupled to the cleaner dust cup to selectively enclose the open end. In some instances, the vacuum cleaner may include a manifold assembly configured to selectively fluidly couple the cleaner dust cup to one of the suction motor inlet or the suction motor outlet. In some instances, the manifold assembly may include a manifold plate coupled to a main body of the vacuum cleaner and a manifold connector coupled to the cleaner dust cup. In some instances, the manifold plate may include a suction opening and an exhaust outlet and the manifold connector includes an air passthrough configured to selectively fluidly couple to one of the suction opening or the exhaust outlet. In some instances, the suction opening may be formed in a first surface of the manifold plate and the exhaust outlet is formed in a second surface of the manifold plate, the first and second surfaces being angled relative to each other. In some instances, the manifold assembly may include a plurality of pivot arms pivotally coupling the manifold plate to the manifold connector. In some instances, the plurality of pivot arms may be configured to pivot such that the manifold connector moves relative to the manifold plate in response to the cleaner dust cup transitioning between the collection position and the emptying position. In some instances, the pivot arms may be biased to urge the cleaner dust cup towards the collection position.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A cleaning system comprising:

a vacuum cleaner including:

an air inlet;

a suction motor having a suction motor inlet and a suction motor outlet; and a cleaner dust cup configured to transition between a collection position and an emptying position, the cleaner dust cup being upstream of the suction motor inlet when in the collection position and downstream of the suction motor outlet when in the emptying position; and a docking station, the docking station including:

a base;

a support extending from the base;

a station dust cup removably coupled to the support; and a receptacle coupled to the support and configured to receive at least a portion of the vacuum cleaner, the cleaner dust cup being fluidly coupled to and upstream of the station dust cup when the vacuum cleaner is received in the receptacle;

wherein the docking station does not include a suction motor for emptying the cleaner dust cup.

2. The cleaning system of claim 1, wherein the receptacle includes a dust cup region for receiving at least a portion of the cleaner dust cup, an inlet region for receiving at least a portion of the air inlet of the vacuum cleaner, and a divider that extends between the dust cup region from the inlet region.

3. The cleaning system of claim 1, wherein the vacuum cleaner further includes a manifold assembly configured to selectively fluidly couple the cleaner dust cup to one of the suction motor inlet or the suction motor outlet.

4. The cleaning system of claim 3, wherein the manifold assembly includes a manifold plate coupled to a main body of the vacuum cleaner and a manifold connector coupled to the cleaner dust cup.

5. The cleaning system of claim 4, wherein the manifold assembly further comprises a plurality of pivot arms pivotally coupling the manifold plate to the manifold connector.

6. The cleaning system of claim 1, wherein the docking station further includes a station air exhaust, at least a portion of the station air exhaust is formed from the station dust cup.

7. The cleaning system of claim 6, wherein at least a portion of the station air exhaust is formed from the support.

8. The cleaning system of claim 7, wherein the station air exhaust includes a plurality of filters, a first filter being coupled to the station dust cup and a second filter being coupled to the support, the second filter being configured to filter smaller debris than the first filter.

9. The cleaning system of claim 1, wherein the receptacle includes a plurality of ramps configured to engage corresponding protrusions of the cleaner dust cup to transition the cleaner dust cup from the collection position to the emptying position in response to the vacuum cleaner being inserted into the receptacle.

10. The cleaning system of claim 1, wherein the cleaner dust cup includes an open end and an openable door pivotally coupled to the cleaner dust cup to selectively enclose the open end.

11. The cleaning system of claim 10, wherein the openable door is transitioned to an open position in response to the vacuum cleaner being inserted into the receptacle.

12. The cleaning system of claim 1, wherein the docking station further includes one or more charging contacts configured to generate a signal, the suction motor being activated in response to receiving the signal.

13. A vacuum cleaner comprising:

a single suction motor having a suction motor inlet and a suction motor outlet; and a cleaner dust cup configured to transition between a collection position and an emptying position, the cleaner dust cup being upstream of the suction motor inlet of the single suction motor when in the collection position and downstream of the suction motor outlet of the single suction motor when in the emptying position.

14. The vacuum cleaner of claim 13, wherein the cleaner dust cup includes an open end and an openable door pivotally coupled to the cleaner dust cup to selectively enclose the open end.

15. The vacuum cleaner of claim 13 further comprising a manifold assembly configured to selectively fluidly couple the cleaner dust cup to one of the suction motor inlet of the single suction motor or the suction motor outlet of the single suction motor.

16. The vacuum cleaner of claim 15, wherein the manifold assembly includes a manifold plate coupled to a main body of the vacuum cleaner and a manifold connector coupled to the cleaner dust cup.

17. The vacuum cleaner of claim 16, wherein the manifold plate includes a suction opening and an exhaust outlet and the manifold connector includes an air passthrough configured to selectively fluidly couple to one of the suction opening or the exhaust outlet.

18. The vacuum cleaner of claim 17, wherein the suction opening is formed in a first surface of the manifold plate and the exhaust outlet is formed in a second surface of the manifold plate, the first and second surfaces being angled relative to each other.

19. The vacuum cleaner of claim 16, wherein the manifold assembly further comprises a plurality of pivot arms pivotally coupling the manifold plate to the manifold connector.

20. The vacuum cleaner of claim 19, wherein the plurality of pivot arms are configured to pivot such that the manifold connector moves relative to the manifold plate in response to the cleaner dust cup transitioning between the collection position and the emptying position.

21. The vacuum cleaner of claim 20, wherein the pivot arms are biased to urge the cleaner dust cup towards the collection position.

22. A cleaning system comprising:

a vacuum cleaner including:

an air inlet;

a single suction motor having a suction motor inlet and a suction motor outlet; and a cleaner dust cup configured to transition between a collection position and an emptying position, the cleaner dust cup being upstream of the suction motor inlet of the single suction motor when in the collection position and downstream of the suction motor outlet of the single suction motor when in the emptying position; and a docking station, the docking station including:

a base;

a support extending from the base;

a station dust cup removably coupled to the support; and a receptacle coupled to the support and configured to receive at least a portion of the vacuum cleaner, the cleaner dust cup being fluidly coupled to and upstream of the station dust cup when the vacuum cleaner is received in the receptacle.

23. The cleaning system of claim 22, wherein the docking station does not include a suction motor for emptying the cleaner dust cup.

24. The cleaning system of claim 22, wherein the vacuum cleaner further includes a manifold assembly configured to selectively fluidly couple the cleaner dust cup to one of the suction motor inlet of the single suction motor or the suction motor outlet of the single suction motor.

25. The cleaning system of claim 24, wherein the manifold assembly includes a manifold plate coupled to a main body of the vacuum cleaner and a manifold connector coupled to the cleaner dust cup.

26. The vacuum cleaner of claim 25, wherein the manifold plate includes a suction opening and an exhaust outlet and the manifold connector includes an air passthrough configured to selectively fluidly couple to one of the suction opening or the exhaust outlet.

27. The vacuum cleaner of claim 26, wherein the suction opening is formed in a first surface of the manifold plate and the exhaust outlet is formed in a second surface of the manifold plate, the first and second surfaces being angled relative to each other.

28. The cleaning system of claim 25, wherein the manifold assembly further comprises a plurality of pivot arms pivotally coupling the manifold plate to the manifold connector.

29. The cleaning system of claim 22, wherein the receptacle includes a plurality of ramps configured to engage corresponding protrusions of the cleaner dust cup to transition the cleaner dust cup from the collection position to the emptying position in response to the vacuum cleaner being inserted into the receptacle.

30. The cleaning system of claim 22, wherein the docking station further includes one or more charging contacts configured to generate a signal, the single suction motor being activated in response to receiving the signal.

* * * * *